US005213423A

United States Patent [19]

Mizuno

[11] Patent Number: 5,213,423

[45] Date of Patent: May 25, 1993

[54] PRINTER WITH IMPACT DOT HEAD

[75] Inventor: Shigeki Mizuno, Suwa, Japan

[73] Assignee: Seiko Epson Corporation, Tokyo, Japan

[21] Appl. No.: 928,522

[22] Filed: Aug. 10, 1992

Related U.S. Application Data

[63] Continuation of Ser. No. 550,401, Jul. 10, 1990, abandoned.

[30] Foreign Application Priority Data

Jul. 13, 1989 [JP] Japan ..... 1-180748

[51] Int. Cl.[5] ..... B41J 2/235

[52] U.S. Cl. ..... 400/124; 101/93.05

[58] Field of Search ..... 400/124, 151; 101/93.05

[56] References Cited

U.S. PATENT DOCUMENTS

| | | | |
|---|---|---|---|
| 4,613,246 | 9/1986 | Sugiura et al. . | |
| 4,723,854 | 2/1988 | Sakaida et al. | 400/124 |
| 4,986,676 | 1/1991 | Kimura et al. | 400/124 |
| 4,993,854 | 2/1991 | Sato | 400/124 |
| 4,995,743 | 2/1991 | Bernardis et al. | 400/124 |

*Primary Examiner*—Edgar S. Burr
*Assistant Examiner*—John S. Hilten
*Attorney, Agent, or Firm*—Blum Kaplan

[57] ABSTRACT

An impact dot head for a printer includes a frame and a plurality of printing wires movably supported on the frame in a predetermined array. Each printing wire is bent by a different predetermined amount to be guided when moved. A plurality of armatures are respectively coupled to a respective one of the printing wires for moving the printing wires. A plurality of magnetic cores are respectively associated with each one of the armatures for selectively driving the armatures. Each of the armatures is driven by its respective magnetic core between a rest position and a printing position. A retaining member is supported on the frame and has a plurality of openings each of which is respectfully associated with one of the armatures. A plurality of coil springs each of which is supported in a respective one of the openings normally biases the armatures in the rest position. Each of the openings has a depth corresponding to the amount of bending of the printing wire associated therewith.

8 Claims, 4 Drawing Sheets

FIG. 1
PRIOR ART
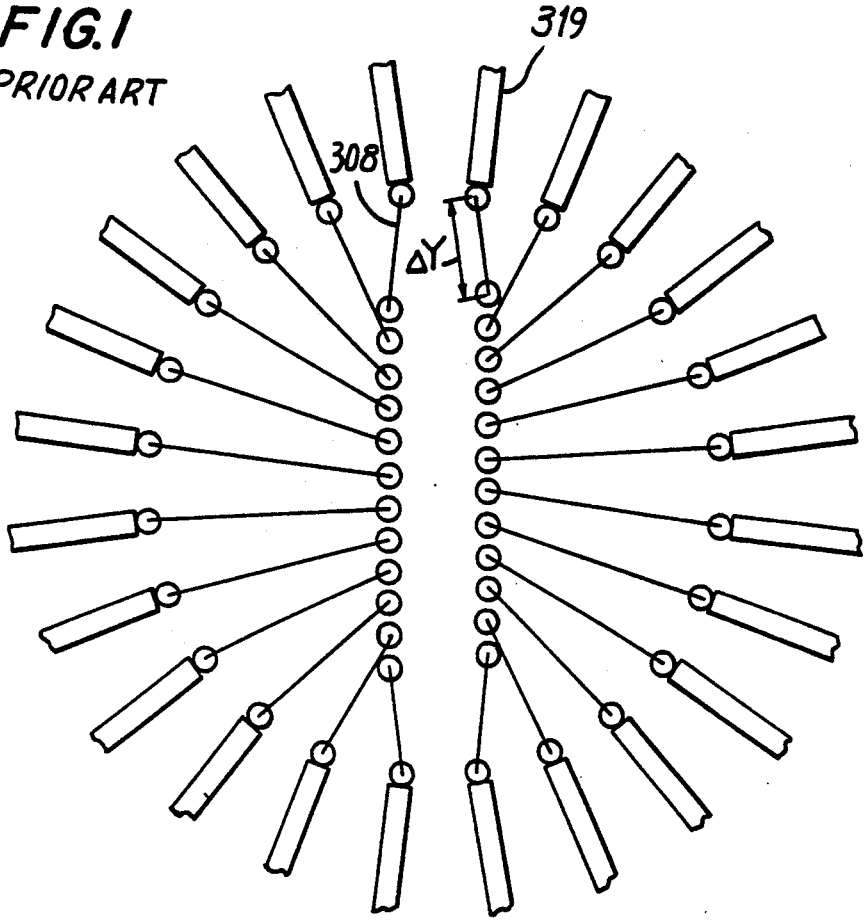
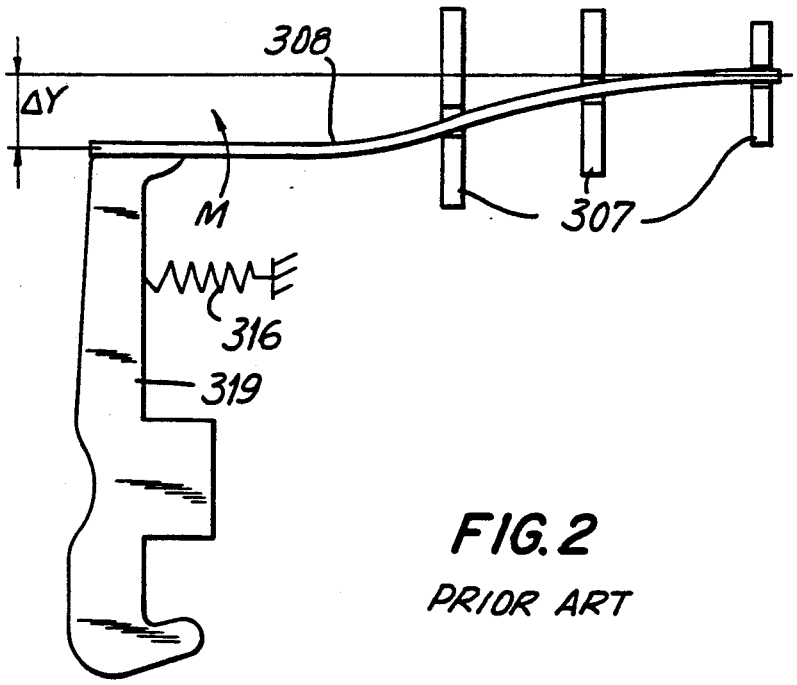
FIG. 2
PRIOR ART

PRINTER WITH IMPACT DOT HEAD

This is a continuation of application Ser. No. 07/550,401, filed Jul. 10, 1990, now abandoned.

BACKGROUND OF THE INVENTION

The present invention relates generally to an impact printer, and, in particular, to a printer provided with an improved impact dot head.

Reference is first made to FIGS. 1 and 2 of the drawings to describe a conventional impact printer construction. Referring specifically to FIG. 1, conventional impact dot head printers have a wire arrangement as depicted therein. The print head includes a plurality of printing wires 308 coupled respectively to armatures 319 which drive the wires. Printing wires 308 and armatures 319 are arranged in a circular array at equally spaced intervals. Further, the printing tips of the wires are arranged in a linear matrix array. In FIG. 2, each armature 319 is maintained in a waiting or rest state by means of a spring force provided from a restoring coil spring 316. Printer wire 308 is supported by a plurality of wire guides 307 in an untensioned (i.e., relaxed) state.

The construction of such a conventional printer establishes a different bending $\Delta Y$ of each printing wire 308 as depicted in FIGS. 1 and 2. In this manner, a bending moment M of printing wire 308 differs for each armature 319. Further, the bending moment M develops a distinct rotational force for each armature. Accordingly, the retaining force or restoring force produced during the waiting state of armature 319 equals the sum of the spring force developed by the restoring spring and the force created by rotating the armature developed from the bending moment M of printing wire 308. Therefore, the spring force of the restoring spring is equal with respect to each armature. However, the retaining force differs for each armature causing different printing impact for each armature and therefore making uniform printing quality unattainable.

To overcome these problems, the prior art has changed the setting angle of printing wire 308 with respect to each armature to obtain a uniform restoring force. In addition, a method has been disclosed to change the restoring spring of each armature to obtain a uniform restoring force. Such a system is disclosed, for example, in Japanese Patent Laid-Open No. 152870/84 dated Feb. 19, 1983. However, the above arrangements have failed to create uniform printing from an impact dot head and increased performance while increasing the number of parts and the associated assembly cost.

Accordingly, it is desired to provide an improved impact dot head for a printer which increases the performance of the printer by producing a uniform printing quality obtained without increasing the assembling cost or the number of parts.

SUMMARY OF THE INVENTION

Generally speaking, in accordance with the present invention, an impact dot head for a printer is provided. The impact dot head includes a frame and a plurality of printing wires movably supported on the frame in a predetermined array. Each of the printing wires is bent by a differing predetermined amount to be guided when moved. An armature is coupled to each respective one of the printing wires for selectively moving the printing wires A plurality of magnetic cores are provided each of which is respectively associated with one of the armatures for selectively driving the armatures. Each armature is driven by its respective magnetic core between a rest position and a printing position. A retaining member is supported on the frame and includes a plurality of openings each of which is respectively associated with one of the armatures. A plurality of coil springs each of which is supported in a respective one of the openings are provided. The coil springs normally bias the armatures in their rest position. Each of the openings in the retaining member has a depth corresponding to the amount of bending of the printing wire associated therewith.

Accordingly, it is an object of the invention to provide a printer having an improved impact dot head.

Another object of the invention is to provide a printer having an impact dot head which creates uniform printing on a recording medium.

Still another object of the invention is to provide a printer with an impact dot head where uniform printing may be obtained without increasing the assembly or production cost.

Yet another object of the invention is to provide a printer with an impact dot head which compensates for the differing amounts of bending of the printing wires.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a schematic plan view depicting a conventional printing wire arrangement constructed in accordance with the prior art;

FIG. 2 is a schematic side elevational view of a printing wire, an armature and a restoring spring arranged in accordance with the prior art;

DETAILED DESCRIPTION OF THE PREFERRED EMBODIMENTS

Figure 3:
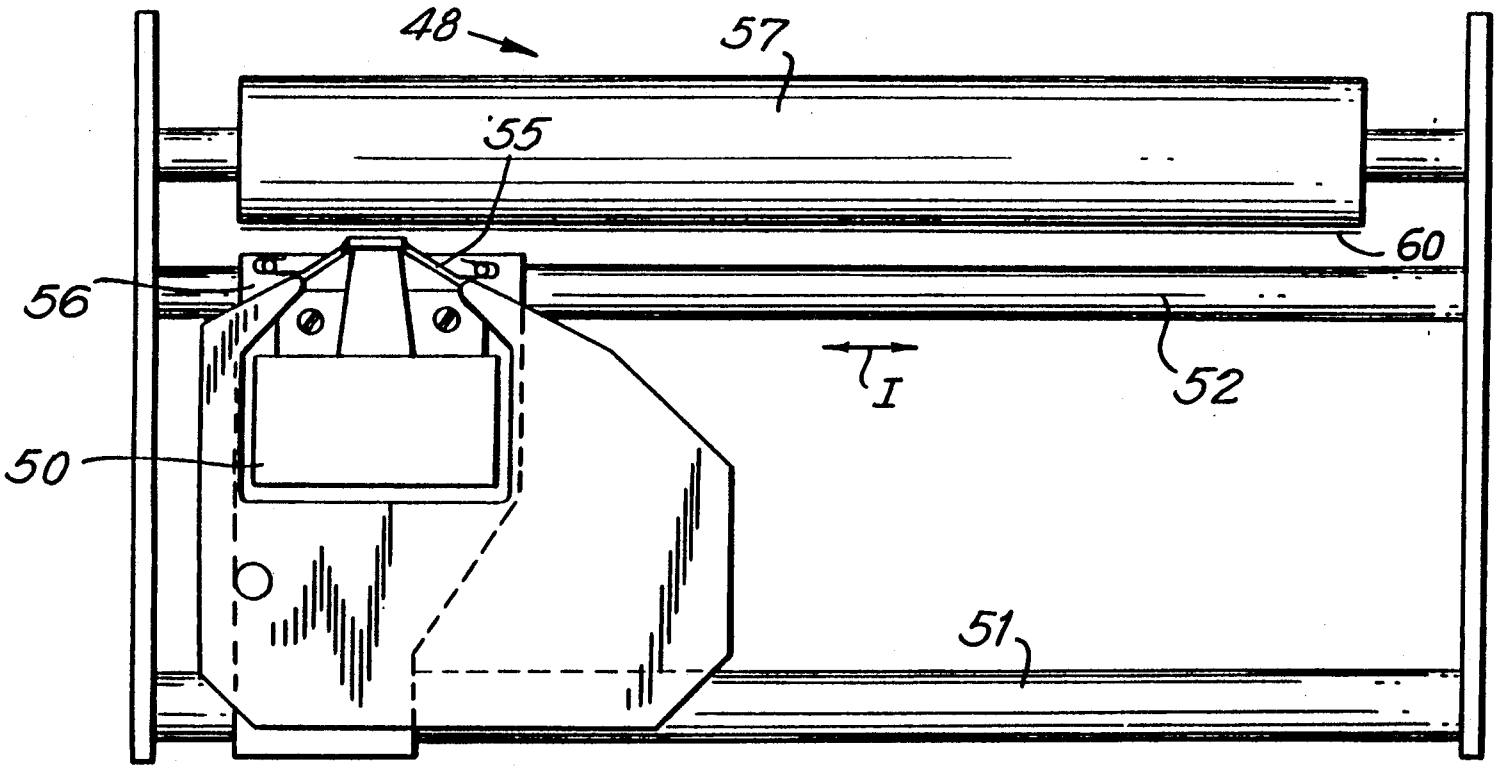
FIG. 3 is a top plan view of a printer having an impact dot head constructed in accordance with the invention.
Figure 4:
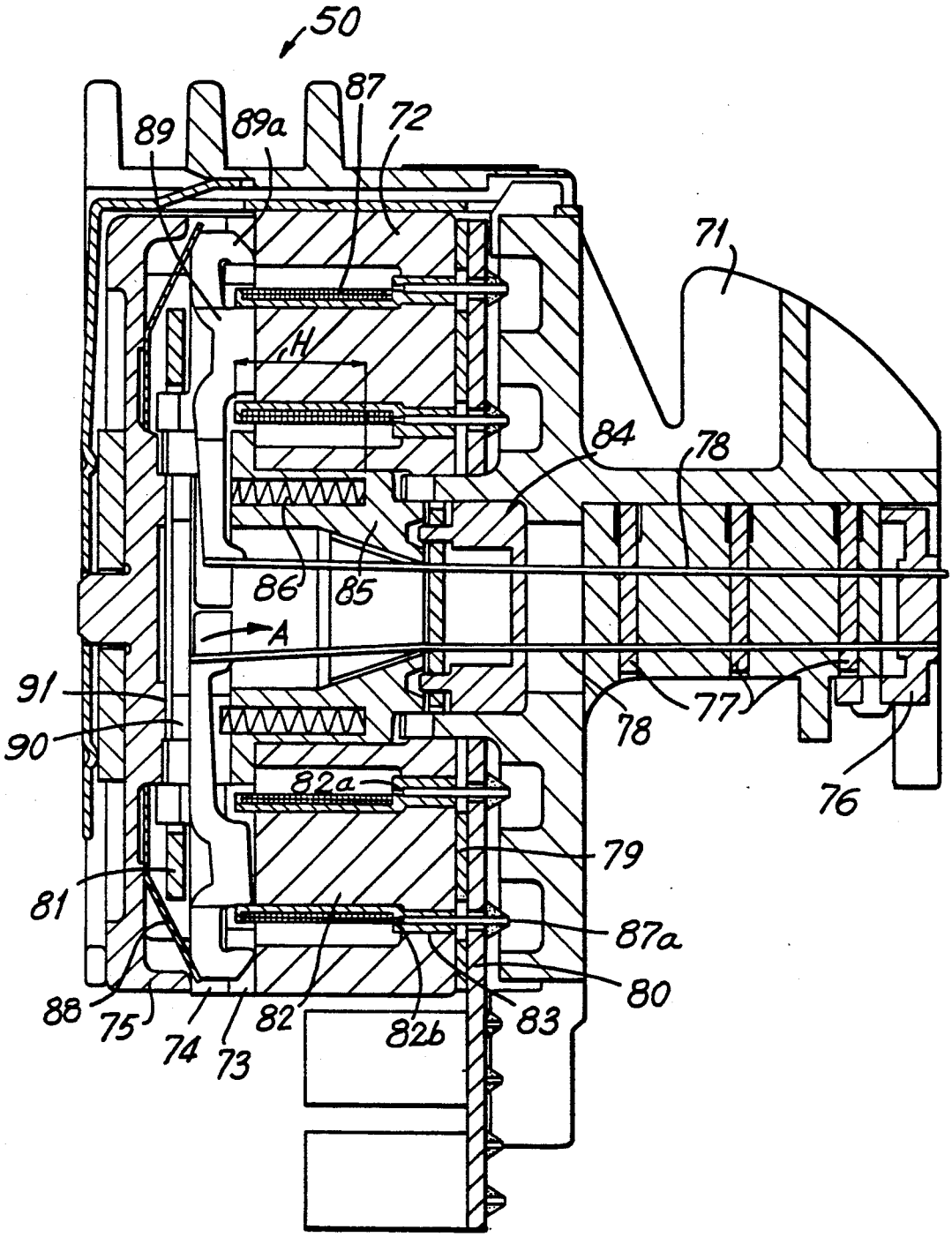
FIG. 4 is an enlarged sectional view of the impact dot head depicted in FIG. 3.

Reference is made to FIGS. 3 and 4 of the drawings which depict a printer, generally indicated at 48, having an impact dot head 50 constructed in accordance with the present invention. Impact dot head 50 is supported on a carriage 56 which is slidingly supported on rods 51 and 52 adjacent to a platen 57. Carriage 56 performs a reciprocal movement in the direction of arrow I along platen 57 and the rods 51 and 52. Printing medium 60 is arranged between platen 57 and an ink ribbon 55. The arrangement prints figures, letters and the like on printing medium 60 by the interaction of impact dot head 50, carriage 56, platen 57 and ink ribbon 55.

Referring now specifically to FIG. 4, impact dot head 50 includes a frame 72 provided with a plurality of magnetic cores 82 in a standing configuration. A coil 87 is wrapped around each core 82 to form an electromagnet. Two through holes 82*a* and 82*b* are included on each core 82 at the bottom surface of frame 72. Terminal portion 87*a* of coils 87 is fixed in a constant state to a substrate plate 80 by soldering through an insulation plate 79.

On the upper surface of the peripheral edge of frame 72, a yoke 73, a side yoke 74 and an armature holder 75 are laminated thereon. At the facing portion of each core 82, armatures 89 are arranged on a circle at equally divided intervals. A tip portion of each armature 89 is attached respectively to each printing wire 78 by brazing a linking portion of printing wire 78 to armature 89 in a circular arrangement at equally divided intervals.

As further shown in detail in FIG. 4, impact dot head 50 is constructed so that a peripheral edge 100 of frame 72, an edge 103 of magnetic core 82 and an edge 105 of inner wall 104 are disposed in the same plane. Supporting point 89*a*, which acts as the fulcrum of armature 89, is brought in contact with peripheral edge 100 at frame 72 and the surface of the outside face of yoke plate 73. In this arrangement, armature 89 is held in position by supporting point 88. Restoring spring holder 85 is positioned in inner wall 104 formed in frame 72. Further, restoring spring holder 85 is positioned by edge 105 of inner wall 104. Based thereon, a gap formed between an attracting surface 102 of armature 89 and edge 103 of magnetic core 82 can be formed with high accuracy. As can be readily seen by this configuration, peripheral edge 100 of frame 72, edge 103 of magnetic core 82, and edge 105 of inner wall 104 are disposed in the same plane.

As shown clearly in FIG. 4, a tip guide 76 coupled to a nose 71, plural wire guides 77 and a back guide 84 act in concert to retain printing wires 78. In this manner, printing wires 78 are guided to form a zigzag matrix arrangement of two vertical arrays extending at the tip portion of printing wire 78. Accordingly, the degree of bending for each printing wire 78 is different for each armature 89.

Figure 5:
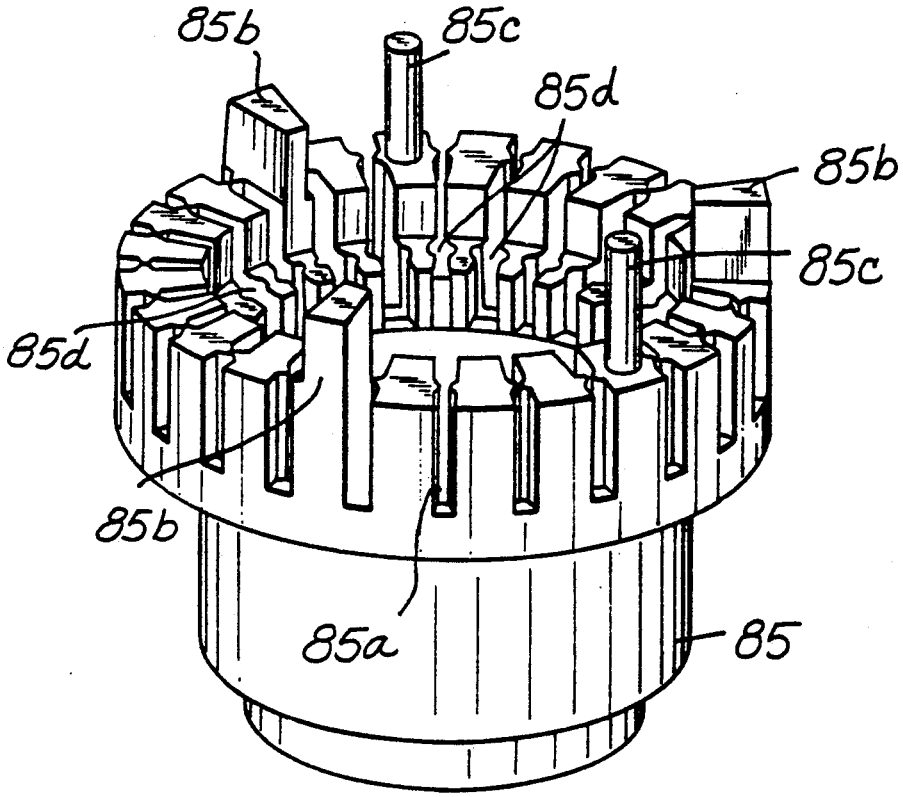
FIG. 5 is a perspective view of the restoring spring holder depicted in FIG. 4.

Referring additionally to FIG. 5, at the middle opening of frame 72, a restoring spring holder 85 is provided with a plurality of openings 85*d* molded from a thermoplastic resin. The depth of openings 85*d* vary depending on their location within spring holder 85. A restoring spring 86 is inserted into each opening 85*d* which acts to force armature 89 to form a contact with the side of a damper 90 by the pressure created by restoring spring 86. An armature 89 and damper 90 are used for each restoring spring 86. A wire in which the amount of bending $\Delta Y$ is small in FIG. 2 makes a small contribution to the restoring force of the armature due to the amount of bending of the wire.

The depth H of opening 85*d* of restoring spring 85 is small at the position where the amount of the bending of printing wire 78 is small. Therefore, the restoring force corresponding to restoring spring 85 is large. On the other hand, the restoring force relating to printing wire 78 becomes large at the position where the amount of bending of the printing wire $\Delta Y$ is large. Accordingly, the depth H of opening 85*d* of the restoring spring 85 is made large to make the restoring spring force corresponding to restoring spring 86 small. In this manner, a distinct bending moment is established for each printing wire 78 to control the depth H of opening 85*d* of restoring spring holder 85. This allows the restoring forces for each of armatures 89 to be constant. Depth H of openings 85*d* varies in the range of $\pm 0.4$ mm.

A plurality of slot portions 85*a* are provided in restoring spring holder 85 to determine the lateral position of armature 89. Further, slot portions 85*a* act as a guide for armature 89. In addition, three convex portions 85*b* are provided in restoring spring holder 85. Convex portions 85*b* have a trapezoidal cross section to serve as a guide during the insertion of armature holder 75. Restoring spring holder 85 further includes two cylindrical convex portions 85*c* which determine the position of the spring pressing the supporting point 88 in armature holder 75. The supporting point portion 89*a* of armature 89 is directed to the upper surface of the peripheral edge of frame 72 by means of a spring. The spring activates armature 89 by pressing supporting point 88 attached to a lever holder 75. Lever holder 75 is rotatably mounted about a supporting point portion 89*a*.

Each armature 89 remains biased in a rest state by its respective restoring spring 86. Restoring spring 86 forces armature 89 in a ready state against damper 90 by the pressure exerted thereby. While pressure is exerted against armature 89, a pulse power supply is directed to coil 87. When the pulse power supply is activated, an attraction force is created by the attraction between armature 89 and core 82. Armature 89 is accelerated due to the attraction force which begins the rotating movement in the direction of arrow A about supporting point 89*a*.

Accordingly, printing wire 78 projects out beyond tip guide 76 to print a dot on printing medium 60 of FIG. 3. After the collision, a restoring action causes armature 89 to return to its rest position due to the force created by restoring spring 86. The spring force is retained after coming into collision with damper 90 to complete the first printing step.

During the printing step described above, the amount of bending of each printing wire 78 differs for each armature 89. In this manner, the amount of rotation for each armature 89 also differs. Accordingly, depth H of opening 85*d* in which restoring spring 86 is inserted, is defined by the restoring force of armature 89. The restoring force of armature 89 is dependent upon the rotating force of armature 89 on the basis of the bending of each printing wire 78. The configuration further enables the printing force of each printing wire 78 to be uniform. Additionally, uniform printing quality may be obtained by controlling the depth H of each opening 85*d* in which each restoring spring 86 is inserted into restoring spring holder 85. In this manner, the present invention requires no increase in cost, parts or time for assembly.

Accordingly, a printer with an impact dot head is provided with a construction wherein the depth of each opening for the insertion of a spring corresponds to the amount of bending of each printing wire. In this manner, the restoring force of the armature becomes uniform which makes it possible to obtain a uniform printing quality. Further, since only the depth of the opening for each restoring spring is the restoring spring holder is changed, the cost of an impact dot head remains at a relatively low cost.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. An impact dot head for a printer comprising a frame, said frame including an inner wall having an edge and an inner surface, a plurality of printing wires movably supported on said frame in a predetermined array, each said printing wire being bent by differing predetermined amounts to be guided when moved, a plurality of armatures each respectively coupled to a respective one of said printing wires for moving said printing wires, each said armature having a fulcrum, said frame having a peripheral edge contacting each said fulcrum, a plurality of magnetic cores having a surface for attracting said plurality of armatures, each of said plurality of magnetic cores respectively associated with one of said armatures for selectively driving said armatures, each said armature being driven by its respective magnetic core between a rest position and printing position, a retaining member supported on said frame at said inner surface of said inner wall of said frame where said printing wires are positioned, said retaining member having a plurality of openings, each of said openings being respectively associated with one of said armatures, said retaining member contacting said edge of said inner wall of said frame and being positioned in a printing direction by said edge of said inner wall of said frame, a plurality of coil springs each of which is supported in a respective one of said openings, each of said coil springs being received by a respective one of said openings of said retaining member, said coil springs normally biasing said associated armatures in their rest position, each of said coil springs in combination with said magnetic cores driving said respective armatures towards said magnetic cores and said printing wires, each of said openings having a depth corresponding to the amount of bending of the printing wire associated therewith; said peripheral edge of said frame contacting said armatures, said surface of said magnetic core attracting said armatures and said edge of said inner wall positioning said retaining member being disposed in the same plane.

2. The impact dot head as claimed in claim 1, wherein the portion where said armatures are coupled to said printing wires is arranged in a circular array, said printing wires having tips, said tips being arranged in a linear matrix array.

3. The impact dot head as claimed in claim 1, wherein said retaining member includes projections for positioning said retaining member on said frame.

4. The impact dot head as claimed in claim 1, wherein said openings in said retaining member have a depth which vary in the range of ±0.4 mm.

5. An impact dot matrix printer including a housing, a platen supported on the housing, a carriage slidingly supported on said housing adjacent said platen, a print head having a frame supported on said carriage, said frame including an inner wall having an edge and an inner surface, a plurality of printing wires movably supported on said print head in a predetermined array, each said printing wire being bent by differing predetermined amounts to be guided when moved, a plurality of armatures each respectively coupled to a respective one of said printing wires for moving said printing wires, each said armature having a fulcrum, said frame having a peripheral edge contacting each said fulcrum, a plurality of magnetic cores having a surface for attracting said plurality of armatures, each of said plurality of magnetic cores being respectively associated with one of said armatures for selectively driving said armatures, each said armature being driven by its respective magnetic core between a rest position and a printing position, a retaining member supported on said print head at said inner surface of said inner wall of said frame where said printing wires are positioned, said retaining member having a plurality of openings, each of said openings being respectively associated with one of said armatures, said retaining member contacting said edge of said inner wall of said frame and being positioned in a printing direction by said edge of said inner wall of said frame, a plurality of coil springs each of which is supported in a respective one of said openings, each of said coil springs being received by a respective one of said openings of said retaining member, said coil springs normally biasing said associated armatures in their rest position, each of said coil springs in combination with said magnetic cores driving said respective armatures towards said magnetic cores and said printing wires, each of said openings having a depth corresponding to the amount of bending of the printing wires associated therewith; said peripheral edge of said frame abutting said armatures, said surface of said magnetic cores attracting said armatures and said edge of said inner wall positioning said retaining member being disposed in the same plane.

6. The impact dot head as claimed in claim 5, wherein the portion wherein said armatures are coupled to said printing wires is arranged in a circular array, said printing wires having tips, said tips being arranged in a matrix array.

7. The impact dot head as claimed in claim 5, wherein said retaining member includes projections for positioning said retaining member on said frame.

8. The impact dot head as claimed in claim 5, wherein said openings in said retaining member have a depth which vary in the range of ±0.4 mm.

* * * * *